United States Patent [19]

Heywang

[11] 4,004,088

[45] Jan. 18, 1977

[54] SYSTEM FOR THE FORMULATION AND TRANSMISSION OF COORDINATE INFORMATION TO REPRODUCE HANDWRITTEN ITEMS

[75] Inventor: Walter Heywang, Neukeferloh, Germany

[73] Assignee: Siemens Aktiengesellschaft, Berlin & Munich, Germany

[22] Filed: Aug. 7, 1975

[21] Appl. No.: 602,555

[30] Foreign Application Priority Data

Aug. 22, 1974 Germany ..... 2440326

[52] U.S. Cl. ..... 178/18; 178/17.5

[51] Int. Cl.[2] ..... G08C 21/00

[58] Field of Search ..... 178/18, 19, 20, 17.5, 178/23 A; 360/7, 27

[56] References Cited

UNITED STATES PATENTS

| | | | |
|---|---|---|---|
| 2,997,697 | 8/1961 | MacAdam | 178/23 A X |
| 3,448,206 | 6/1969 | Rossberg | 178/17.5 |
| 3,449,515 | 6/1969 | Butzke et al. | 178/17.5 |
| 3,582,916 | 6/1971 | Stock et al. | 360/7 |
| 3,790,709 | 2/1974 | Heywang | 178/18 |
| 3,806,642 | 4/1974 | Veith et al. | 178/18 |

*Primary Examiner*—Thomas A. Robinson
*Attorney, Agent, or Firm*—Hill, Gross, Simpson, Van Santen, Steadman, Chiara & Simpson

[57] ABSTRACT

A device for the transmission of information pertaining to handwriting with a piece of equipment which records the $x$ and $y$-coordinates of the location of the writing pen. The device transmits the coordinates of the writing information after a suitable delay and transmits the coordinates of the commencement point of a new item of writing without delay. In this way the output receives the coordinate information of the commencement point at a time prior to the receipt of information pertaining to the writing itself, thus permitting a lower speed printing device than would be required if the output printer received the new coordinates of a handwritten item substantially simultaneously with the commencement of the coordinate information of the writing.

6 Claims, 2 Drawing Figures

SYSTEM FOR THE FORMULATION AND TRANSMISSION OF COORDINATE INFORMATION TO REPRODUCE HANDWRITTEN ITEMS

BACKGROUND OF THE INVENTION

1. Field of the Invention

The field of art to which this invention pertains is equipment for transmitting $x$-$y$ coordinates of a handwriting device and in particular, to a novel arrangement for delaying the handwriting coordinates while transmitting directly the coordinate information pertaining to a new commencement point of writing.

2. Description of the Prior Art

The U.S. Pat. No. 3,806,642, the U.S. Pat. No. 3,790,709, and IEEE Transactions on Electronic Computers (1964), p. 609 ff describe devices for electronic transmission of handwriting in which from a writing pad equipped with sensors, e.g. mechanical-electrical energy converter, the time sequence of the coordinates of the handguided pen is transmitted to a remote output printer which executes the item of handwriting. In such devices the output printer does not obtain any information when the hand-guided pen is raised in order, for example, to start a new word at another position. Not until the pen is lowered again is the new coordinate information received and transmitted to the output printer. To enable the output printer to record the newly commenced item of handwriting, it must move very rapidly between the raising point and the point of commencement of the new item of handwriting. The data printer must therefore operate at a very high speed, although, in comparison, the movement of the hand is relatively slow.

SUMMARY OF THE INVENTION

It is an important feature of the present invention to provide an improved device for transmitting and printing of handwritten data.

It is also a feature of the present invention to provide an improved device for the transmission and printing of handwritten data using a low speed printer head.

It is a principal object of the present invention to provide a device for the transmission of items of handwriting which includes means for delaying the coordinate information of the handwriting pen during the writing operation and to transmit directly the coordinate information for the commencement of each new item of handwriting.

It is also an object of the present invention to provide a device as described above wherein the means for delaying the input of the coordinate information includes a wheel which is rotatable about its axis and which carries a layer of magnetizable material on its outer surface.

It is another object of the present invention to provide a device as described above wherein the $x$-coordinate information is recorded on a first track, the $y$-coordinate information is recorded on a second track and the information pertaining to the lowering and raising of the writing pen is recorded on a third track.

These and other objects, features and advantages of the present invention will be understood in greater detail from the following description and the associated drawing wherein reference numerals are utilized to designate a preferred embodiment.

DESCRIPTION OF THE PREFERRED EMBODIMENT

Figure 1:
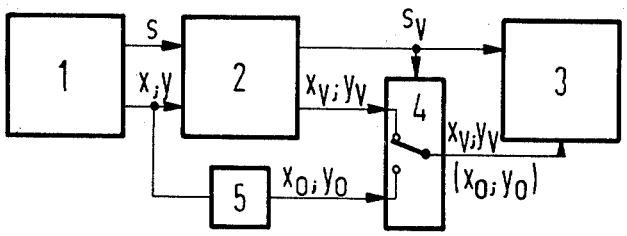
FIG. 1 schematically illustrates the construction of a device in accordance with the invention in a block diagram.

The invention relates to a device for the transmission of items of handwriting with a piece of equipment which records $x$- and $y$-coordinate information of the location of the stylus, which is guided by the hand, and also the information for the lowering and raising of the stylus. The device transmits the information in electrical fashion to an output printer which executes the item of handwriting. The transmitter information controls the raising and lowering of the output printer head and the movement of the printer head over the recording material of the output printer.

It is desirable to also be able to employ printers with lower printing speeds, such as 0.3 m per sec in handwriting transmission devices, in particular because these printers can be produced more economically.

The aim of the invention is to design a device for the transmission of items of handwriting in such manner that the output printer can be a printer which has a printing speed in the order of 0.3 m per sec. This is realized by providing an arrangement which delays the input of the $x$- and $y$- coordinate information of the hand-guided stylus into the output printer by a given time $\Delta t$ while the output printer is executing this item of handwriting, and inputs the commencement coordinate information $x_o$, $y_o$ of the following item of handwriting without delay into the output printer as soon as the output printer has ended the preceding item of handwriting and is raised from the recording material.

The design in accordance with the invention provides the advantage that following the execution of an item of handwriting, the output printer head does not remain at the location of the end of the item of handwriting during the "dead time" until the next lowering command, but even before the lowering command it obtains a new item of coordinate information and thus moves in the direction of the new lowering point prior to the movement of the lowering of the stylus. The printer head is thus provided with a long period of time to cover the path between the raising and lowering points. Consequently, average printing speeds are adequate to reproduce the handwriting.

In the transmission of items of handwriting from a writing pad arranged at the "transmitting end" of the transmission channel to an output printer at the "receiving end" of the transmission channel, disturbances can occur which are caused by a finite build-up time $\tau$ " $\Delta t$ of the transmission channel between transmitter and receiver. In accordance with a particularly advantageous embodiment of the invention these disturbances are eleminated if the arrangement which serves to delay the $x$-$y$ coordinates with associated switching and storage elements is arranged at the transmitting end of the transmission line. In this case the transmission channel is already in the built-up state when the output printer stylus is lowered in order to reproduce an item of handwriting.

Advantageously, the arrangement which serves to delay the input of the coordinate information possesses a wheel which is rotatable about an axis and along the periphery of which is applied a layer of magnetizable material. Means are provided, for example, sound recording heads, with which the $x$-coordinate information is recorded on a first track in the magnetizable materal, the $y$-coordinate information is recorded on a second track, and the information is recorded for lowering and raising and contact and non-contact of the pen with the recording material on a third track. With the aid of other means, e.g. sound reproduction heads which are displaced by a predetermined angle of rotation $\alpha$ in relation to the recording heads on the wheel, these items of information are read out again from the magnetizable layer and transmitted to the output printer. The delay time is determined by the size of the angle $\alpha$ and the rotating speed of the wheel. The speed of rotation of the wheel and this angle $\alpha$ are set to be such that the delay time amounts to between 0.1 and 1 sec.

Referring to the drawing in greater detail, FIG. 1 shows the writing pad identified as numeral 1. The $x,y$)-coordinate information and the information s for the lowering and raising of the stylus are received from this pad and inserted into a delay device 2 at the input end. These items of information are delayed by a predetermined length of time t amounting to, e.g. 0.5 sec., and the delayed items of information $(x,y)_v$ and $s_v$ are input into the output printer 3 which executes the item of handwriting. When the output printer has executed an item of handwriting, and the printer head has been raised, the corresponding item of raising information $s_v$ is conducted to a switch 4 via which, in the presence of this item of raising information $s_v$, the commencement coordinate information $x_o$, $y_o$ of the following item of handwriting is directly input into the output printer 3. A storage element 5 stores the commencement coordinate information of the items of handwriting written on the writing pad. At the output of this storage element 5 there exists the commencement coordinate information $(x_o, y_o)$ of the item of handwriting which is next to be executed by the output printer but has not yet been commenced by the latter. The storage element 5 is constructed in a known manner from the components normally employed for stores. The printer head of the output printer then moves toward the location associated with this item of coordinate information, without having been lowered into position. When the output printer receives a lowering command from the delay device and accordingly, is lowered into position, the delayed items of coordinate information $(x,y)_v$ are inserted into the output printer 3 at the input end. In the simplest circumstances the switching mechanism 4 consists of an electromechanical mechanical switch (relay).

Figure 2:
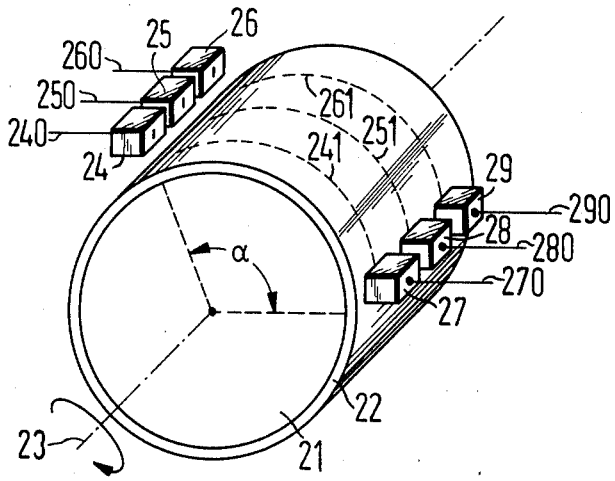
FIG. 2 shows an exemplary embodiment of an arrangement for delaying the $(x,y)$-coordinate information and the lowering and raising information.

FIG. 2 shows an exemplary embodiment of an arrangement for delaying the $(x,y)$-coordinate information and the lowering and raising information. It consists of a wheel 21 coated with a magnetizable layer 22. This wheel rotates at a constant speed about an axis 23. Supply lines 240, 250, 260 supply the items of information in the form of electrical quantities which latter are recorded with recording heads 24, 25, 26 in three tracks 241, 251, 261 onto the magnetizable material. When the wheel has moved through an angle $\alpha$, the recorded information is withdrawn from the reproduction heads 27, 28, 29 and conducted via lines 270, 280, 290 into the non-illustrated ouput printer.

I claim as my invention:

1. A system for the formulation and transmission of coordinate information to reproduce handwritten items comprising:

a writing pad for receiving handwriting and for producing $x$-$y$ coordinate information of the location of the stylus of a pen as it is guided by hand across the pad and for producing information corresponding to the raising and lowering of the stylus from the pad, an output printer for utilizing the $x$-$y$ coordinate information for reproducing the handwriting and which utilizes the raising and lowering information for raising and lowering the printer head and for moving the printer head over the recording material, means for delaying the $x$-$y$ coordinate information for a fixed time interval and for providing said delayed information to said output printer, means for supplying $x$-$y$ coordinate information corresponding to the commencement of a new item of data without delay to said printer at a time corresponding substantially to the instant that the printer is raised from the recording material after executing a given item of handwriting.

2. A system in accordance with claim 1 wherein a storage element is provided to store said commencement coordinate information of the items of handwriting written on said writing pad.

3. A system in accordance with claim 1 wherein said delay means for the coordinate information and associated switching and storage elements are arranged at the transmitting end of a transmission channel.

4. A system in accordance with claim 1 wherein said delay means for the coordinate information includes a wheel which is rotatable about an axis and which has on its surface a layer of magnetizable material.

5. A system in accordance with claim 4 wherein said wheel has three tracks, the $x$-coordinate information being recorded on a first track, the $y$-coordinate information being recorded on a second track, and the information for lowering and raising the pen stylus being recorded on a third track, and means being provided to read-out the recorded items of information from the magnetizable material and transmit the latter to the output printer.

6. In a system for the formulation and transmission of data corresponding to coordinates of a handwriting pen and a pad as well as data corresponding to the raising and lowering of the pen on the pad, a means for delaying the coordinate data during a writing action of the pen and for transmitting said delayed data to a printer, and means for coupling without delay data corresponding to the raising and lowering of the pen on the pad to said printer whereby said printer receives coordinate data for commencement of a new item of handwriting prior to the receipt of coordinate data corresponding to the writing itself.

* * * * *